US011640829B2

(12) United States Patent
Zavesky et al.

(10) Patent No.: US 11,640,829 B2
(45) **Date of Patent: *May 2, 2023**

(54) METHOD FOR EMBEDDING AND EXECUTING AUDIO SEMANTICS

(71) Applicant: AT&T Intellectual Property I, L.P., Atlanta, GA (US)

(72) Inventors: Eric Zavesky, Austin, TX (US); Jason DeCuir, Cedar Park, TX (US); Robert Gratz, Lockhart, TX (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 78 days.

This patent is subject to a terminal disclaimer.

(21) Appl. No.: 17/331,931

(22) Filed: May 27, 2021

(65) Prior Publication Data

US 2021/0287690 A1 Sep. 16, 2021

Related U.S. Application Data

(63) Continuation of application No. 16/399,527, filed on Apr. 30, 2019, now Pat. No. 11,056,127.

(51) Int. Cl.
*G10L 21/013* (2013.01)

(52) U.S. Cl.
CPC .... *G10L 21/013* (2013.01); *G10L 2021/0135* (2013.01)

(58) Field of Classification Search
CPC ..... G10L 19/018; G10L 21/034; G10L 15/24
See application file for complete search history.

(56) References Cited

U.S. PATENT DOCUMENTS

| | | | | |
|---|---|---|---|---|
| 6,332,026 | B1 * | 12/2001 | Kuusama | H04S 3/008 381/104 |
| 9,671,863 | B2 | 6/2017 | Fein et al. | |
| 9,933,847 | B1 | 4/2018 | Ross et al. | |
| 9,965,675 | B2 | 5/2018 | Sehinas et al. | |
| 9,986,219 | B1 | 5/2018 | Ross | |
| 9,990,774 | B2 | 6/2018 | Mao | |
| 10,067,737 | B1 | 9/2018 | Ozery | |
| 10,101,961 | B2 | 10/2018 | Gao | |

(Continued)

OTHER PUBLICATIONS

Broll, et al., "An Infrastructure for Realizing Custom-Tailored Augmented Reality User Interfaces", 2005, 13 pages.

(Continued)

*Primary Examiner* — Daniel C Washburn
*Assistant Examiner* — Athar N Pasha
(74) *Attorney, Agent, or Firm* — Guntin & Gust, PLC; Miyoung Shin

(57) ABSTRACT

Aspects of the subject disclosure may include, for example, a device that includes a processing system having a processor and a memory that stores executable instructions that, when executed by the processing system, facilitate performance of operations, where the operations include determining parameters for adapting audio in the content to the device, wherein the device renders the content, and wherein the parameters are based on semantic metadata embedded in the content, adapting the audio in the content based on the parameters, and rendering the content, as adapted by the parameters, to represent a semantic in the semantic metadata. Other embodiments are disclosed.

20 Claims, 7 Drawing Sheets

(56) References Cited

U.S. PATENT DOCUMENTS

| | | | | |
|---|---|---|---|---|
| 10,600,408 | B1 | 3/2020 | Smith et al. | |
| 11,056,127 | B2 * | 7/2021 | Zavesky | G10H 1/40 |
| 2014/0253743 | A1 | 9/2014 | Loxam et al. | |
| 2014/0267228 | A1 | 9/2014 | Ofek et al. | |
| 2015/0006184 | A1 | 1/2015 | Marti et al. | |
| 2015/0042679 | A1 | 2/2015 | Järvenpää | |
| 2015/0046252 | A1 | 2/2015 | Hart | |
| 2015/0279050 | A1 | 10/2015 | Yang et al. | |
| 2016/0266865 | A1 | 9/2016 | Tsingos et al. | |
| 2016/0299563 | A1 | 10/2016 | Stafford et al. | |
| 2016/0364124 | A1 | 12/2016 | Heater | |
| 2017/0011557 | A1 | 1/2017 | Lee et al. | |
| 2017/0300113 | A1 | 10/2017 | Han | |
| 2017/0371411 | A1 | 12/2017 | Vinmani et al. | |
| 2018/0060891 | A1 | 3/2018 | Von Cavallar et al. | |
| 2018/0137771 | A1 | 5/2018 | Wahidy et al. | |
| 2018/0190020 | A1 | 7/2018 | Mullins | |
| 2018/0260026 | A1 | 9/2018 | Drake et al. | |
| 2018/0276895 | A1 | 9/2018 | Hodge | |
| 2019/0043236 | A1 | 2/2019 | Jones et al. | |
| 2020/0090645 | A1 * | 3/2020 | Satoh | G06F 40/253 |
| 2020/0344549 | A1 | 10/2020 | Wegener | |
| 2020/0349960 | A1 | 11/2020 | Zavesky et al. | |

OTHER PUBLICATIONS

Cosic, et al., "Physiology-driven adaptive virtual reality stimulation for prevention and treatment of stress related disorders", Nov. 1, 2010, 6 pages.

Julier, et al., "Adaptive User Interfaces in Augmented Reality", Oct. 7, 2003, 8 pages.

Kukolja, et al., "Real-Time Emotional State Estimator for Adaptive Virtual Reality Stimulation", May 2009, 11 pages.

Padmanaban, et al., "Optimizing Virtual Reality for All Users Through Gaze-Contingent and Adaptive Focus Displays", Jan. 6, 2017, 6 pages.

Ramanujam, et al., "Method and VR Apparatus for Managing VR Content", Abstract, Sep. 3, 2018, 3 pages.

Shatoetry, "Shatoetry.com", https://web.archive.org/web/20140206115209/http:/shatoetry.com/, Archived on Feb. 6, 2015; retrieved on Nov. 2, 2020, Feb. 6, 2015.

Shatoetry, "Shatoetry.com/how-to-shatoetize", <https://web.archive.org/web/20140212034539/http://shatoetry.com/how-to-shatoetize>, Archived on Feb. 12, 2015; retrieved on Nov. 2, 2020, 2015, 6 pages.

Shatoetry, "Shatoetry.com/top-shatisms", https://web.archive.org/web/20140215032008/http://shatoetry.com/top-shatisms, Archived Feb. 15, 2015, retrieved on Nov. 2, 2020, 2015, 6 pages.

* cited by examiner

300

600

METHOD FOR EMBEDDING AND EXECUTING AUDIO SEMANTICS

CROSS REFERENCE TO RELATED APPLICATION(S)

This application is a continuation of and claims priority to U.S. patent application Ser. No. 16/399,527 filed Apr. 30, 2019. The contents of the foregoing are hereby incorporated by reference into this application as if set forth herein in full.

FIELD OF THE DISCLOSURE

The subject disclosure relates to a method for embedding and executing audio semantics.

BACKGROUND

Static content injections (e.g., lighting within a scene or music swells) may be used to provide semantic expressions. However, a diverse set of playback environments may not convey the semantic expression intended authentically.

BRIEF DESCRIPTION OF THE DRAWINGS

Reference will now be made to the accompanying drawings, which are not necessarily drawn to scale, and wherein.

DETAILED DESCRIPTION

The subject disclosure describes, among other things, illustrative embodiments for rendering semantics in audio content. Other embodiments are described in the subject disclosure.

One or more aspects of the subject disclosure include a device that includes a processing system having a processor and a memory that stores executable instructions that, when executed by the processing system, facilitate performance of operations, where the operations include determining parameters for adapting audio in content to the device, wherein the device renders the content, and wherein the parameters are based on semantic metadata embedded in the content, adapting the audio in the content based on the parameters, and rendering the content, as adapted by the parameters, to represent a semantic in the semantic metadata.

One or more aspects of the subject disclosure include a machine-readable medium, comprising executable instructions that, when executed by a processing system including a processor, facilitate performance of operations, the operations comprising: determining instructions for manipulating audio in content, wherein the instructions are based on semantic metadata embedded in the content; modifying the audio in the content based on the instructions to represent a semantic in the semantic metadata, thereby creating modified content; and sending the modified content to a device for rendering.

One or more aspects of the subject disclosure include a method that includes determining, by a processing system including a processor, instructions for manipulating audio in content, wherein the instructions are determined based on semantic metadata embedded in the content, modifying, by the processing system, the audio in the content based on the instructions; and rendering, by the processing system, the content, wherein the audio modified by the instructions represents a semantic in the semantic metadata.

Figure 1:
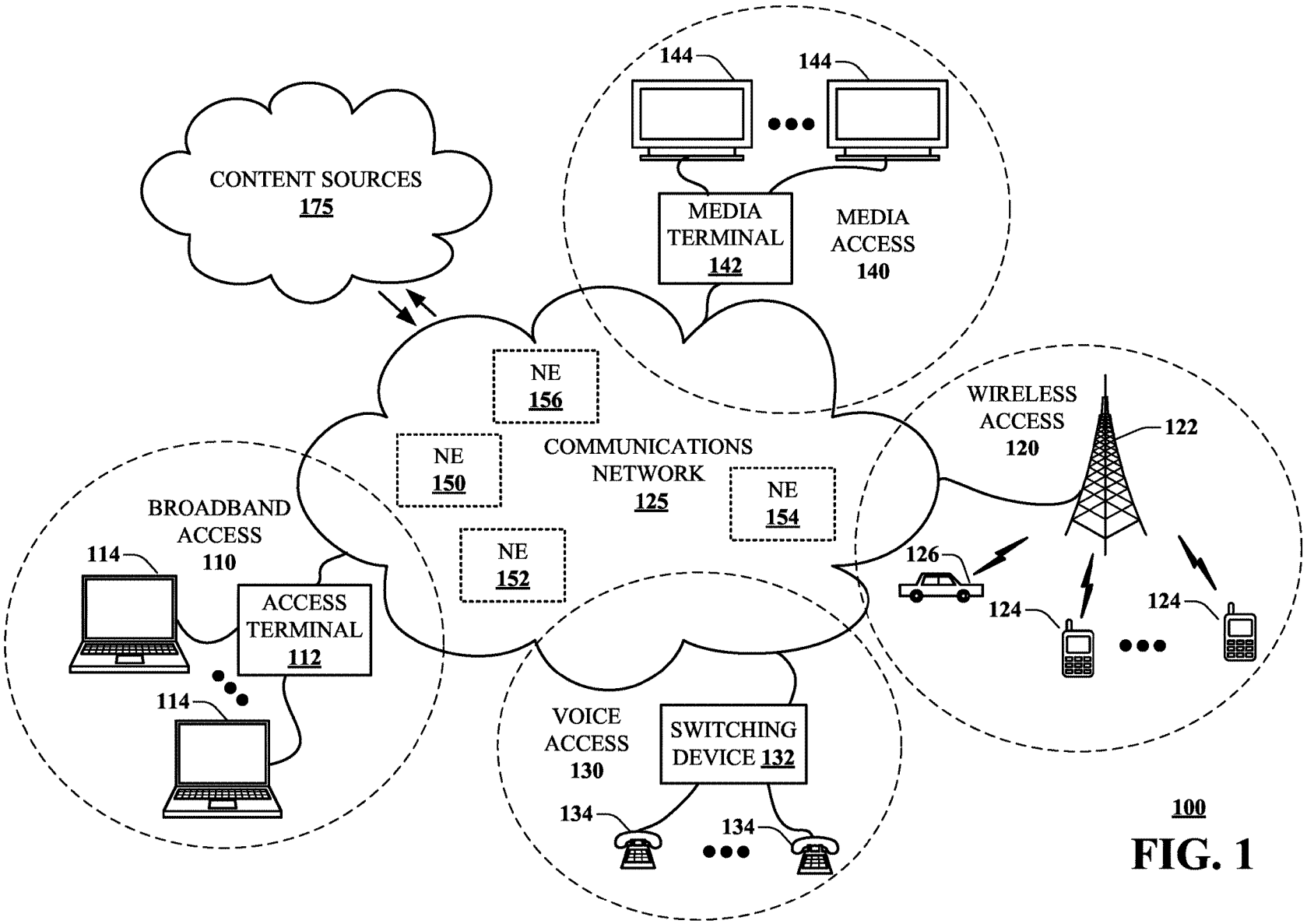
FIG. 1 is a block diagram illustrating an exemplary, non-limiting embodiment of a communications network in accordance with various aspects described herein.

Referring now to FIG. 1, a block diagram is shown illustrating an example, non-limiting embodiment of a communications network 100 in accordance with various aspects described herein. For example, communications network 100 can facilitate in whole or in part one or more components of system 200 illustrated in FIG. 2A. In particular, a communications network 125 is presented for providing broadband access 110 to a plurality of data terminals 114 via access terminal 112, wireless access 120 to a plurality of mobile devices 124 and vehicle 126 via base station or access point 122, voice access 130 to a plurality of telephony devices 134, via switching device 132 and/or media access 140 to a plurality of audio/video display devices 144 via media terminal 142. In addition, communication network 125 is coupled to one or more content sources 175 of audio, video, graphics, text and/or other media. While broadband access 110, wireless access 120, voice access 130 and media access 140 are shown separately, one or more of these forms of access can be combined to provide multiple access services to a single client device (e.g., mobile devices 124 can receive media content via media terminal 142, data terminal 114 can be provided voice access via switching device 132, and so on).

The communications network 125 includes a plurality of network elements (NE) 150, 152, 154, 156, etc. for facilitating the broadband access 110, wireless access 120, voice access 130, media access 140 and/or the distribution of content from content sources 175. The communications network 125 can include a circuit switched or packet switched network, a voice over Internet protocol (VoIP) network, Internet protocol (IP) network, a cable network, a passive or active optical network, a 4G, 5G, or higher generation wireless access network, WIMAX network, UltraWideband network, personal area network or other wireless access network, a broadcast satellite network and/or other communications network.

In various embodiments, the access terminal 112 can include a digital subscriber line access multiplexer (DSLAM), cable modem termination system (CMTS), optical line terminal (OLT) and/or other access terminal. The data terminals 114 can include personal computers, laptop computers, netbook computers, tablets or other computing devices along with digital subscriber line (DSL) modems, data over coax service interface specification (DOCSIS)

modems or other cable modems, a wireless modem such as a 4G, 5G, or higher generation modem, an optical modem and/or other access devices.

In various embodiments, the base station or access point 122 can include a 4G, 5G, or higher generation base station, an access point that operates via an 802.11 standard such as 802.11n, 802.11ac or other wireless access terminal. The mobile devices 124 can include mobile phones, e-readers, tablets, phablets, wireless modems, and/or other mobile computing devices.

In various embodiments, the switching device 132 can include a private branch exchange or central office switch, a media services gateway, VoIP gateway or other gateway device and/or other switching device. The telephony devices 134 can include traditional telephones (with or without a terminal adapter), VoIP telephones and/or other telephony devices.

In various embodiments, the media terminal 142 can include a cable head-end or other TV head-end, a satellite receiver, gateway or other media terminal 142. The display devices 144 can include televisions with or without a set top box, personal computers and/or other display devices.

In various embodiments, the content sources 175 include broadcast television and radio sources, video on demand platforms and streaming video and audio services platforms, one or more content data networks, data servers, web servers and other content servers, and/or other sources of media.

In various embodiments, the communications network 125 can include wired, optical and/or wireless links and the network elements 150, 152, 154, 156, etc. can include service switching points, signal transfer points, service control points, network gateways, media distribution hubs, servers, firewalls, routers, edge devices, switches and other network nodes for routing and controlling communications traffic over wired, optical and wireless links as part of the Internet and other public networks as well as one or more private networks, for managing subscriber access, for billing and network management and for supporting other network functions.

Figure 2A:
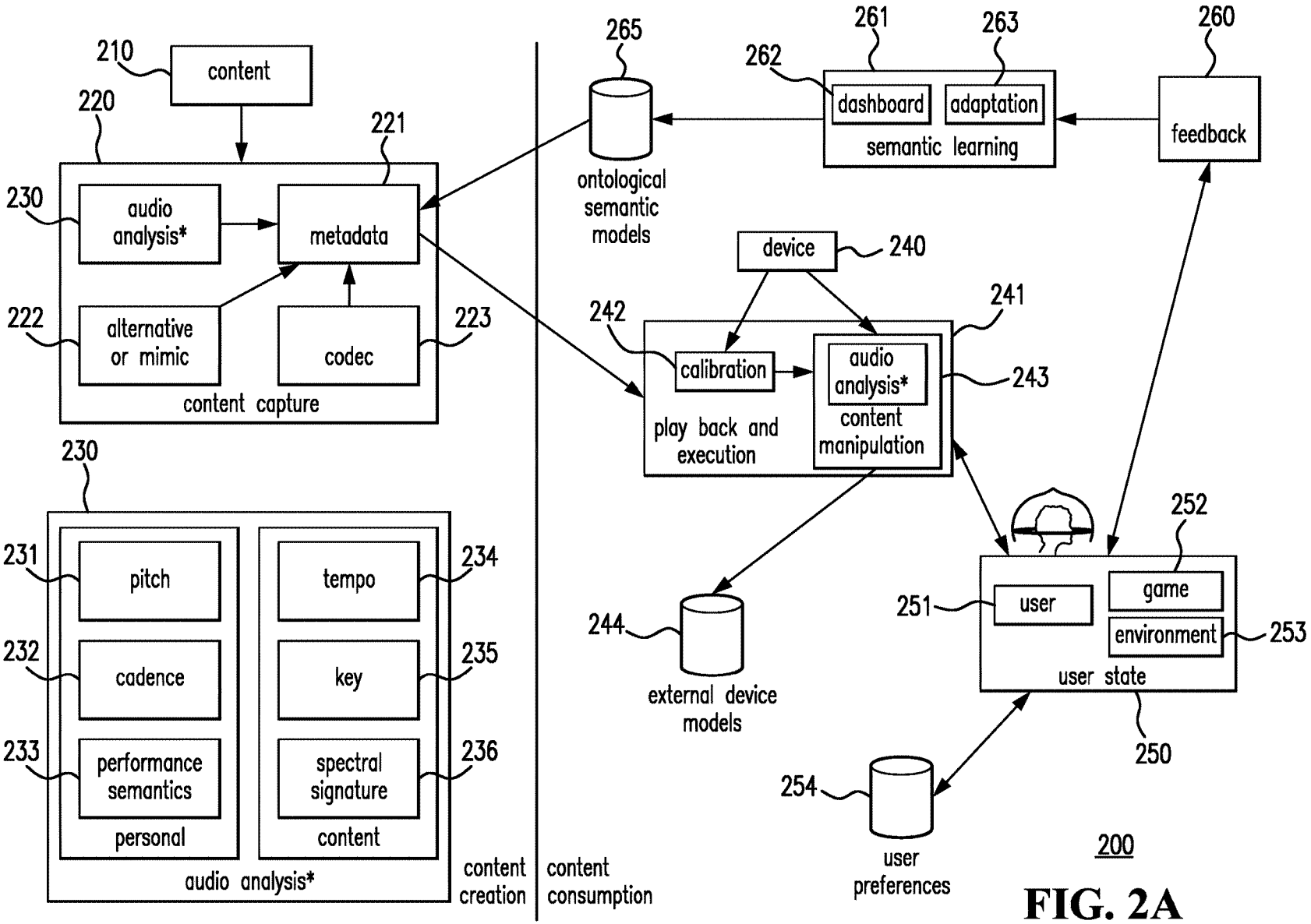
FIG. 2A is a block diagram illustrating an example, non-limiting embodiment of a system for embedding and executing audio semantics within the communication network of FIG. 1 in accordance with various aspects described herein.

FIG. 2A is a block diagram illustrating an example, non-limiting embodiment of a system for embedding and executing audio semantics within the communication network of FIG. 1 in accordance with various aspects described herein. Various elements of system 200, which may be implemented on a computing platform, such as a distributed processing environment, are shown in FIG. 2A and described below:

Content 210 is audio or audiovisual data that is created by a content creator.

As content 210 is captured (content capture 220), the creator may want an explicit feeling to be overtly expressed during creation and embedding of audio semantics, but additional modalities besides sound, like visual or haptic, can be expressed. For example, the content creator may wish to express semantics portraying a feeling of "happy," and may achieve such expression within a home theater with lighting manipulations, low-volume low-frequency audio, and spatialized sound. However, such semantic expression may not map to a mobile device like a phone or smart watch. Instead, these devices may need additional actions like vibration, echo or delay, or visual-timed thermal activation.

Metadata 221 is a schema or format for device and media control, possibly extended for a user state and other manipulations. The metadata 221 links to a device model and a semantic database for an experience aligned to the intend effect provided by the content creator.

Alternative or mimic content 222 is a method for providing alternate audio or pre-analyzed content to use as an example for manipulations of content 210. This alternative content 222 allows the creator to utilize prior work or audio semantics that are challenging to describe directly in the system.

A codec 223 is the system component that encodes the semantics that were specified by the content creator for a specific piece of content 210. In one embodiment, the semantics are encoded as a static or constant set for an entire piece of content 210 (e.g., "happy"). In another embodiment, the semantics are encoded as continuous evolution of explicit semantics specified, with execution timing within the content 210 (e.g., "happy at 0.2 seconds, sad at 2.3 seconds"), or a weighted formulation of semantics in either of the above scenarios (e.g. "happy and excited at 0.2 seconds, happy and confused at 1.0 seconds, sad at 2.3 seconds").

Audio analysis 230 is a method performed by system 200 for analyzing components of content from both the content creator as well as content from live playback systems. During audio analysis 230, the system 200 can suggest audio semantics by analyzing captured content 210. By using an understanding of what is being captured by cameras, microphones, or other sensors, system 200 can suggest semantics for encoding and more authentic playback on future systems. With a combination of time and frequency analysis tools, the system looks for similar patterns from prior ontological models while also discovering new patterns in the audio. For example, if the ontology only provides semantics for up-beat pop songs, a heavy baseline or slow and muted brass instrument score would be identified as new semantics.

All components of the audio would be analyzed and used to ascribe characteristic properties to specific semantics, such as pitch 231, cadence 232, performance semantics 233, tempo 234, key 235, and spectral signature 236, as defined below. While audio analysis 230 captures only a few examples of personal (i.e., as applied to non-melodic elements) and content (i.e., as applied to all elements of content as a whole, or in components), audio analysis 230 allows those skilled in the art to understand the functional intentions. It should also be noted that content may be segregated into components, both by spatial channels (stereo, left, right, front, etc.) as well as actor channels (the strings, or singers in a song, etc.).

During audio analysis 230, system 200 analyzes the pitch 231 of speakers, singers, or other non-melodic sound elements of audio. In existing speech analysis art, this may include the formant (f0) of a speaker or any additional resonant harmonics (f1-fN) that may be characteristic of that non-melodic element.

Also, system 200 may analyze the cadence 232 (or pauses) and speed of both non-melodic sound elements (i.e. speakers or singers) and melodic elements (i.e. the beats of a drum) to determine the temporal patterns of these elements.

Additionally, system 200 analyzes performance semantics 233 of non-melodic sound elements, like speakers and singers. Similar to the traditional musical notation "fortissimo" to mean "very loud," certain performance semantics may be provided or detected through audio analysis 230. Specifically, these performance semantics 233 can describe emotional elements (happy, sad, upset, etc.), sound-based elements (guttural, nasal, etc.), and even the intensity of elements themselves (valence, arousal, dominance).

Further, system 200 analyzes the tempo 234 of individual channels or the overall sound channel. Typically, tempo 234 is determined by low-frequency (e.g., drum) beats, but tempo 234 could also be determined by repeating audio segments.

Key 235 of content 210 can be determined during audio analysis 230 by first performing frequency mapping of individual sounds to semitones and from a collection of semitones into a musical key signature that contains one of a set of sharps and flats. While the key 235 may also indicate typical performance semantics 233, the two features are denoted separately because they may correspond to different melodic and non-melodic elements.

System 200 can also recognize the spectral signature 236 of content 210 by analyzing different granularities of spectrum analysis using time-frequency transform functions, like Fourier or wavelet family of functions. These different granularities may vary in their sampling window (i.e., 30 milliseconds, 100 milliseconds, etc.) or they may vary in the granularity of detail (e.g., the audio bandwidth).

Device 240 is the playback environment (e.g., cell phone, virtual reality system, home theater, etc.) that reproduces the intended semantic from the embedded metadata and may activate different modalities to approximate the intent on the content 210 being consumed by the end user.

Playback and execution 241 is a system component that executes the modulations of audio content across different modalities according to the embedded metadata. It uses decoded semantics and a possible calibration stage to faithfully execute these semantics across various playback devices 240.

Calibration 242 is a system component that may be activated to calibrate the content manipulations needed for a new device. Calibration is learned by executing content manipulations specified by the semantics, sampling the manipulated content (either directly by monitoring the audio output digital channel or by an additional microphone on the device 240), and computing the needed additional manipulations to achieve the semantic specified in the metadata 221 by the content creator on a particular device 240. For example, calibration 242 would be triggered if a new combination of device and semantic is encountered after decoding the metadata 221 for a particular content.

Content manipulation 243 is the method that modifies the original audio according to the desired semantics, like pitch 231, cadence 232, performance semantics 233, tempo 234, key 235, and spectral signature 236 of the original content. Upon reading the semantics embedded in the metadata 221 from the content creator, system 200 attempts to faithfully reproduce the characteristics of the semantics specified for a particular device. Content 210 is manipulated using audio processing algorithms common in the art of signal analysis. In one embodiment, some of those algorithms may directly align to the characteristics detected by audio analysis 230 component. In another embodiment, content manipulation 243 algorithms may simultaneously satisfy multiple characteristics defined by a semantic specification. For example, if the semantic is "creepy" the manipulations may lower the pitch and/or reduce the tempo or speed of the content 210. In another embodiment, content manipulation 243 may be realized differently according to the capabilities of the device 240. In one example, a home theater device 240 may have high-powered subwoofers and be capable of producing audio in the range of 5-100 Hz, such that a "booming" semantic can faithfully execute a low-frequency rumble of thunder. However, a second mobile device 240 may have speakers only capable of producing audio in the range of 2-8 kHz, but it has a physical vibration device, so the content manipulation 243 would utilize the vibration device in lieu of a subwoofer to faithfully execute the "booming" semantic on a low-frequency rumble of thunder.

External device models 244 are information stored in a database that describes the required content manipulation 243 methods to achieve the desired semantic for playback device 240. In one embodiment, external device models 244 are continuously updated with new manipulation instructions from combinations of devices, semantics, and user state 250 information. In another embodiment, external device models 244 reside on a distributed or networked database instance, and are synchronized with some determined frequency, or polled as needed by the system 200. In another embodiment, external device models 244 are computed at one time during system creation, and are distributed in a static, non-adapting form for a specific model. In yet another embodiment, content manipulation 243 instructions for external device models 244 that do not exist in the database are duplicated from records of similar device models previously stored in the database.

Normal operation of the playback and execution 241 component may involve the coordination of multiple sub-components, like calibration 242, audio analysis 230, and content manipulation 243. In one embodiment, this may include the small adaptation of content manipulation 243 instructions from previous external device models 244 for a newer model device 240. In another embodiment, this adaptation could be adapting the content manipulation 243 instructions to better accommodate the available resources on a new device 240 that may be underpowered for the previous content manipulation 243 technique. For example, if a pitch 231 adjustment is specified by semantics from the codec 223, one device may need to use a less precise sampling technique (e.g., lower frequency) because the device has less memory. In another example, one or more underlying content manipulation 243 algorithms may need to be substituted for a device, such as executing a pitch 231 adjustment and a tempo 234 adjustment, by slightly slowing down the audio playback speed in the time domain instead of using advanced frequency-domain methods. In yet another embodiment, the device 240 may be in a previously unknown user state 250 that requires additional manipulation according to the semantic. For example, if analysis of the audio via on-device microphone indicates a "noisy environment" but the desired semantic is "serene" for a part of content, the system may use calibration 242 to first sense that content manipulation 243 is not effective, and then increase the volume of the content.

User state 250 is a system component that simplifies the user's overall context into a set of known semantics. This simplification process may be informed by sensors that are associated with the user 251, the user's environment context 253, or digital signals coming from a game context (i.e., game engine or application). In each of these examples, the task of the user state 250 component is to inform the playback system about conditions of the user wherever possible. In one embodiment, the semantics conveyed from the user state 250 may have intensity levels computed by the combining outputs of the user 251, environment state 253 and game engine state 252. In another embodiment, historical semantics associated with a particular user and the state of the user during time of semantic determination may be archived into a user preferences database 254. The user preferences database 254 may be used to inform the user state 250 component of semantics to generate based when only partial information from a sub-component (user 251, game 252, or environment 253 states) are available. The user preferences database 254 may also include user preferences augmented by signals of affinity as determined by the feedback 260 sub-component. In another example, the user preferences database 254 may contain weightings specific to user preferences that inform the semantic combination algorithm within the user state 250.

User 251 is a component that collects and translates sensor data associated with the user into content semantics, where possible. In one embodiment, the sensor data may include biometrics about the user (heart rate, perspiration level, activity level, drowsiness, etc.). This set of biometrics is incomplete and may be further augmented by biometrics and sensor data known to those in the art. In another embodiment, user state 250 may also convey historical states of the user 251 that have occurred over time. For example, the state may indicate "serene," "worried," and "excited" as previous semantic states that the user 251 experienced in the last ten minutes.

Game 252 is a component that maps a digital game state into a possible set of semantics. While this component may not be realized for all content experiences, those with interactive components, such as virtual reality (VR), augmented reality (AR), etc., may have external software as a game engine that further describes the state of the user within the game. For example, if the user is in a tense logic battle with a foe the semantic may indicate "perplexed." In another example, if the user has just succeeded at a significant game task the semantic may indicate "proud."

Environment 253 is a system component that maps physical environment information into semantics. In one embodiment, environment information may be derived from location. For example, a home receives one semantic ("peaceful") and a busy street receives another ("frantic"). In another embodiment, environment 253 may receive different semantics according to information about occupancy ("lonely" versus "crowded"), time of year ("solemn" versus "relaxed"), or temperature ("arid" versus "refreshing"). In one embodiment, semantics are provided by a retrieval service that indicates conditions within an environment 253 around the user and playback location. In another embodiment, semantics are provided by the mapping of other sensor data around the users.

Feedback 260 may be supplied by a user to validate the user experience. Feedback 260 may be collected explicitly (rating systems, affinity "like" indicators) or implicitly (alignment of user states to affirming semantics). Feedback 260 may also include simple signals of affinity or stronger signals indicating explicit suggestions for additional or alternate semantics. In one embodiment, the user may have an interactive slider associated with content playback and execution 241 that can vary the semantic of content 210 between one or more of the content creator's original intentions. For example, if the semantics for content 210 were specified as the triplet "foreboding," "scary," and "suspenseful," the user may be prompted (or may explicitly choose) to provide a preference for one of these semantics. In another embodiment, the user may have controls or indicators that provide feedback 260 on the executed content manipulation 243. In one example, the playback and execution 241 determines the use of content manipulation 243 methods to increase the volume of high-frequency components of an animal's scream to match the semantic "scary." The user may have sensitivity to loud, high-pitched noises, so during operation, feedback may be provided to refrain from using that frequency range, which would be stored as a content manipulation 243 in either the user preferences database 254, the external device models 244 database, or both databases. In yet another embodiment, the simple successful execution of a semantic during playback and execution 241 on a device 240 may be considered a passive form of feedback 260 and may be collected for subsequent learning stages.

Semantic learning 261 is a discovery of what manipulations were successful, and can be uploaded to a central (or personal) repository for effects. This sub-component complements the learning of successful content manipulations 243 on playback devices 240. Here, feedback 260 can help to determine when or if a semantic was realizable (e.g., executed with some content manipulations 243 on devices 240) and its correlation to a user state 250. Semantic learning 261 enhances the semantics known to the system 200 and its outputs are most commonly utilized during explicit interactions with a user that has recently experienced playback content manipulation 243. In one example, this user is also the content creator, who is fine tuning the set of semantics (and their timed execution) for their desired content. In another example, the user is a non-creator, but is interested in additional personalization of their experience with the system at a more general (not content specific) level akin to global user preferences in modern software applications.

Dashboard 262 is an interface for updating effects, including a generalized ontology for audio semantics. In one embodiment, dashboard 262 allows a user to explore when semantics were executed on the content 210. In a traditional time-line view, the audio could be displayed in a frequency or waveform visualization and time indicators would explicitly indicate semantics and their intensity for execution. In another embodiment, dashboard 262 may be a numerical representation of a semantics and their executions (statistically aggregated by total execution time or total execution instances) across devices, users, or environments. For example, if the content was a soundtrack to a suspenseful movie, the dashboard may indicate the frequency of the semantic "surprise" or "suspenseful" in a bar chart. In a similar example, the dashboard 262 may indicate that the low-frequency manipulations required by the semantic "mysterious" were not executed well on mobile devices.

Adaptation 263 is a component that allows the system 200 to create or adapt a semantic using all of the properties of another semantic. In one embodiment, a content creator (here, as the user of the playback system as well) may want to create a new semantic that isn't sufficiently captured by the known set of semantic models. In one example, the creator has two sample semantics that should be used as input semantics for a final semantic. The system can analyze the characteristics of these two semantics and derive a combined (possibly with different weightings) semantic for the author to encode with the new content and test on playback. In another example, the content author prefers to describe the semantic with plain language or a series of logic instructions (e.g., "campy, which is suspenseful but more comical than scary"). In this example, the semantic learning system can map such an expression through natural language understanding (NLU) tools to create a new semantic. Afterwards, the author can associate the semantic with the new content and evaluate it on playback.

Ontological semantic models 265 contain semantics and their descriptions. These descriptions may include textual definitions, utility and usage information, typical content manipulation operations, effected audio characteristics (from audio analysis), and their relationships to other semantics for the system (i.e., the composition rules for the ontology). In one embodiment, the ontology 265 stores each of these descriptions as a different attribute (or connection) between semantics, such that the ontology 265 can be organized (and optionally displayed on the dashboard 262) according to the user's needs. In another embodiment, the semantics can be mapped into a lexical- or language-based form such that they can be connected with the use of external information sources. In one example, a thesaurus (e.g., WordNet) may be used to make connections between semantics. In a similar example, a logical relational database (e.g., OpenCyc) may define relationships of containment ("has a") or membership ("is a") that can used to make connections between semantics. In another example, the text of a written manuscript (e.g., a book, a movie script, a web page, a news article) may be used to determine the connections between semantics. In yet another example, advanced natural language understanding (NLU) algorithms (e.g., word2vec) may be utilized to apply an externally learned semantic embedding to the semantics in the ontological models 265. In this example, mathematical operations can be expressed in the embedding space but realized in the semantic space, like "queen minus woman equals king."

Figure 2B:
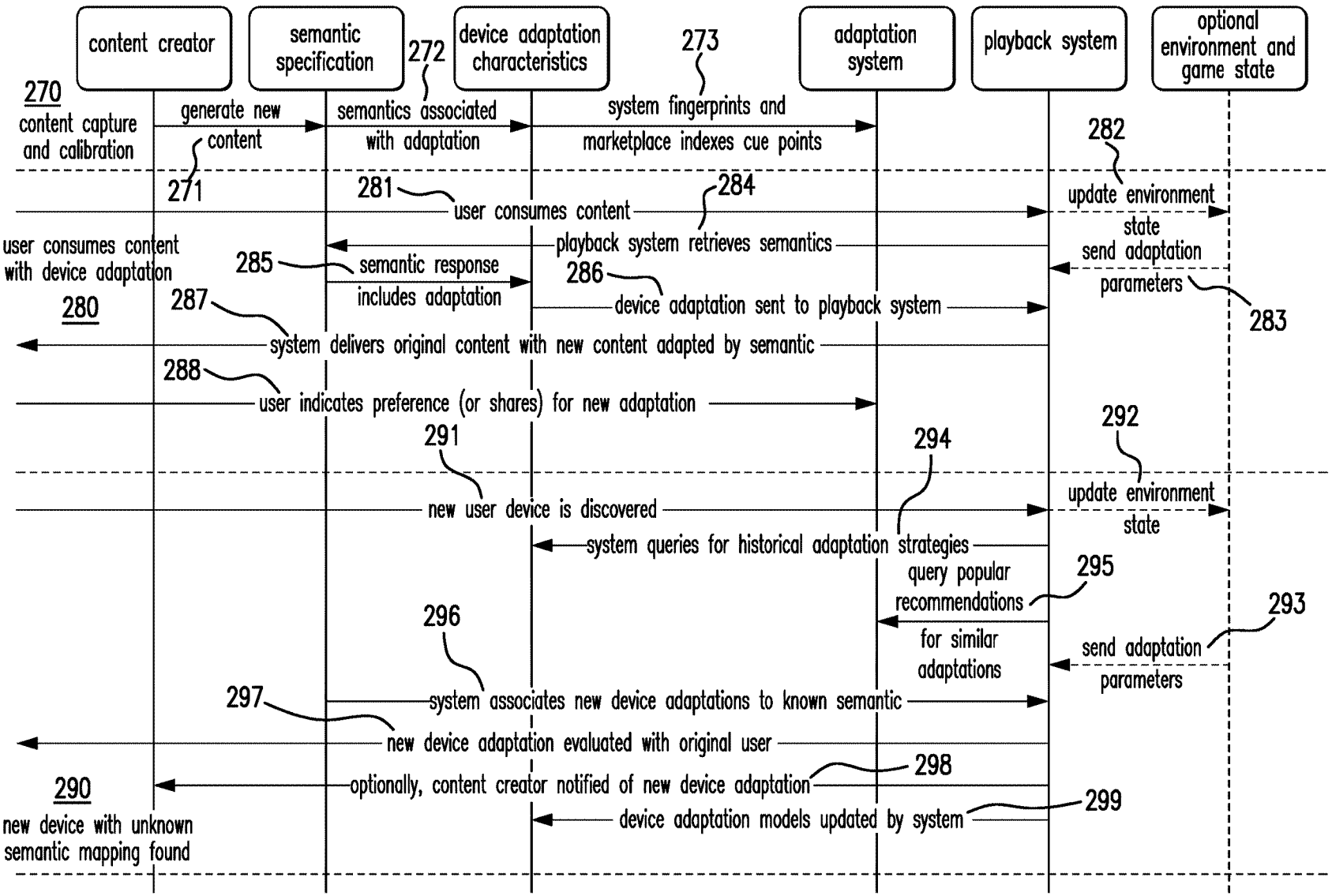
FIG. 2B depicts an illustrative embodiment of methods in accordance with various aspects described herein.

FIG. 2B depicts an illustrative embodiment of methods in accordance with various aspects described herein. As shown in FIG. 2B, a method 270 of capturing content by a content creator is illustrated. Relating FIG. 2B to the discussion of FIG. 2A, the term "adaptation" shall be synonymous used as short-hand for content manipulation 243. In step 271, the content creator generates new content, and the new content is matched to a semantic specification. In step 272, the system determines semantics associated with adapting the semantics to the device adaptation characteristics. Next, in step 273, the system fingerprints cue points in the content, which are indexed specifically for each piece of content as metadata, specifically for devices in external device models 244, and in aggregation for each semantic ontology 265. With these various indexes, playback and execution 241 can best modify content in playback and the semantic learning system 261 can be used for playback and execution 241 of semantics.

Also illustrated in FIG. 2B is a method 280 of consuming content adapted to a playback device. As shown in FIG. 2B, and with reference to FIG. 2A, in step 281, a user requests playback of content 210. In step 282, the system optionally updates the game 252 and environment 253 state. In step 283, the system provides parameters for content manipulation 243 for the device 240, to more accurately represent the semantic in the game 252 or environment 253 context.

Then, in step 284, the playback system retrieves semantics relevant to the current device 240 from external device models 244 that are specific to the content 210. In step 285, the system provides a semantic response that includes content manipulation 243 to adapt the content 210 to the playback device 240. In step 286, the content manipulation 243 is sent to the playback system.

Next, in step 287, the system plays back the original content 210, as adapted by the content manipulation 243. Finally, in step 288, the user optionally indicates feedback 260, or shares a preference for a new adaptation of the content 210.

Also illustrated in FIG. 2B is a method 290 of playing back content 210 on a new device having an unknown semantic mapping. As shown in FIG. 2B, in step 291, the system discovers a new playback device. In step 292, the system optionally updates the game 252 and environment 253 state. In step 293, the system provides parameters for adapting the content 210 to the new device, to more accurately represent the semantic.

Then, in step 294, the system searches for historical adaptation (playback and execution 241 of semantics) strategies. These strategies are required because the playback device 240 has no prior execution instructions for semantics, so the system attempts to start from the most similar previous execution instructions. Many techniques may be utilized, but some examples to associate similarity may be determined by product and model number of the device 240, available hardware components on the device 240 (e.g., the speakers, the size of the body, etc.), form factors of the device 240 (e.g., positioning of speakers relative to hand and viewing positions).

In step 295, the system queries popular recommendations for similar adaptations (successful playback and execution transactions as determined by feedback 260) across external device models 244, semantic ontology 265, or similar users. Popular recommendations may be a fallback for more explicit (and potentially reliable) content manipulation 243 from an existing device model's execution instructions.

Next, in step 296, the system associates the new adaptations (execution instructions) to the new device, based on a known semantic and stores these execution models either locally or in an external (and shared) index. In step 297, the new device adaptation is evaluated by the user.

Next, in step 298, the system optionally notifies the content creator of the new device adaptation. Finally, in step 299, the system updates the device adaptation models stored in the external device database.

While for purposes of simplicity of explanation, the respective processes are shown and described as a series of blocks in FIG. 2B, it is to be understood and appreciated that the claimed subject matter is not limited by the order of the blocks, as some blocks may occur in different orders and/or concurrently with other blocks from what is depicted and described herein. Moreover, not all illustrated blocks may be required to implement the methods described herein.

Figure 3:
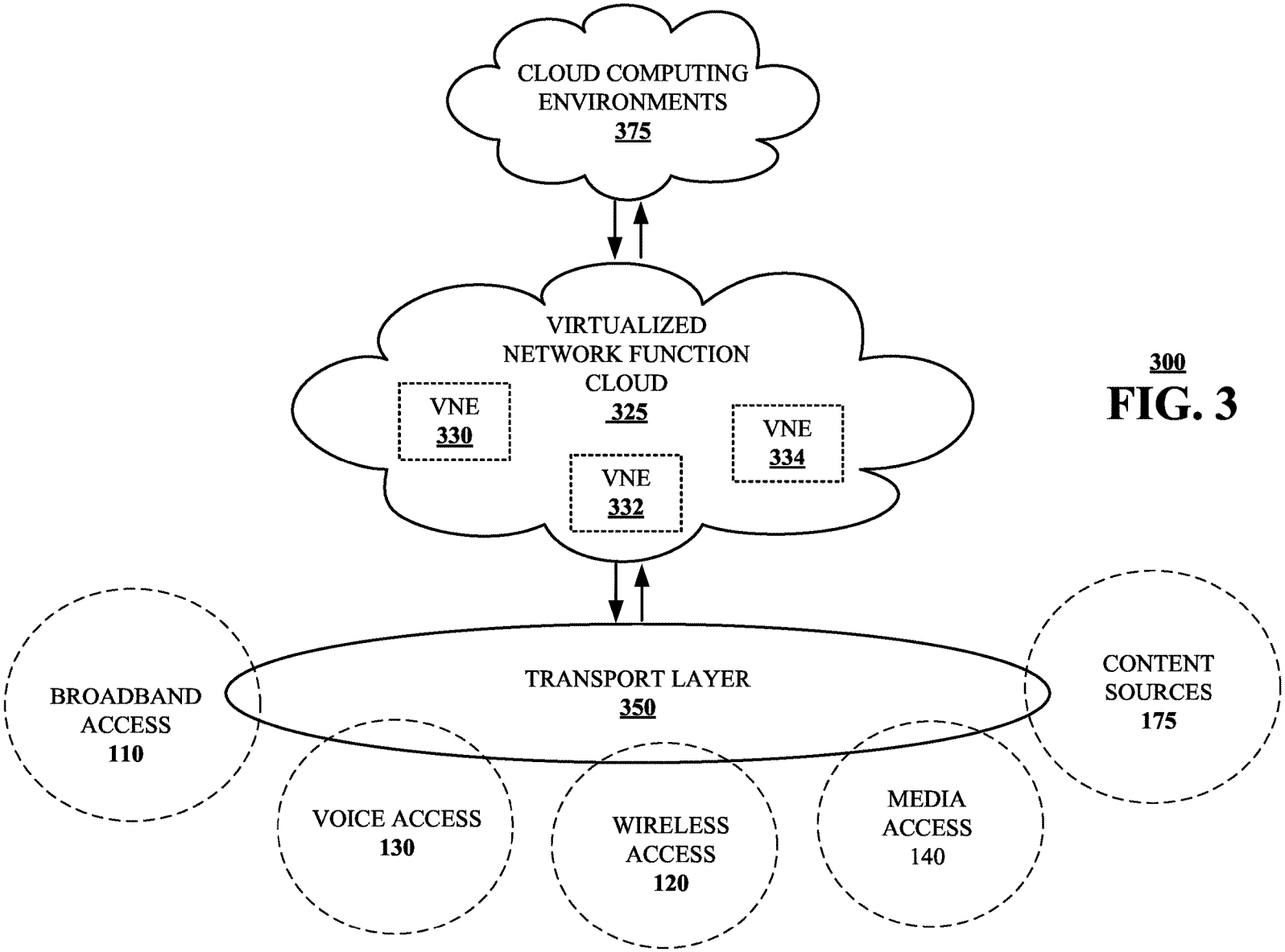
FIG. 3 is a block diagram illustrating an example, non-limiting embodiment of a virtualized communication network in accordance with various aspects described herein.

Referring now to FIG. 3, a block diagram 300 is shown illustrating an example, non-limiting embodiment of a virtualized communication network in accordance with various aspects described herein. In particular a virtualized communication network is presented that can be used to implement some or all of the subsystems and functions of communication network 100, the subsystems and functions of system 200, and methods 270, 280 and 290 presented in FIGS. 1, 2A, 2B and 3. For example, virtualized communication network 300 can facilitate in whole or in part data communication paths providing the flow of data in system 200 illustrated in FIG. 2A.

In particular, a cloud networking architecture is shown that leverages cloud technologies and supports rapid innovation and scalability via a transport layer 350, a virtualized network function cloud 325 and/or one or more cloud computing environments 375. In various embodiments, this cloud networking architecture is an open architecture that leverages application programming interfaces (APIs); reduces complexity from services and operations; supports more nimble business models; and rapidly and seamlessly scales to meet evolving customer requirements including traffic growth, diversity of traffic types, and diversity of performance and reliability expectations.

In contrast to traditional network elements—which are typically integrated to perform a single function, the virtualized communication network employs virtual network elements (VNEs) 330, 332, 334, etc. that perform some or all of the functions of network elements 150, 152, 154, 156, etc. For example, the network architecture can provide a substrate of networking capability, often called Network Function Virtualization Infrastructure (NFVI) or simply infrastructure that is capable of being directed with software and Software Defined Networking (SDN) protocols to perform a broad variety of network functions and services. This infrastructure can include several types of substrates. The most typical type of substrate being servers that support Network Function Virtualization (NFV), followed by packet forwarding capabilities based on generic computing resources, with specialized network technologies brought to bear when general purpose processors or general purpose integrated circuit devices offered by merchants (referred to herein as merchant silicon) are not appropriate. In this case, communication services can be implemented as cloud-centric workloads.

As an example, a traditional network element 150 (shown in FIG. 1), such as an edge router can be implemented via a VNE 330 composed of NFV software modules, merchant silicon, and associated controllers. The software can be written so that increasing workload consumes incremental resources from a common resource pool, and moreover so that it's elastic: so the resources are only consumed when needed. In a similar fashion, other network elements such as other routers, switches, edge caches, and middle-boxes are instantiated from the common resource pool. Such sharing of infrastructure across a broad set of uses makes planning and growing infrastructure easier to manage.

In an embodiment, the transport layer 350 includes fiber, cable, wired and/or wireless transport elements, network elements and interfaces to provide broadband access 110, wireless access 120, voice access 130, media access 140 and/or access to content sources 175 for distribution of content to any or all of the access technologies. In particular, in some cases a network element needs to be positioned at a specific place, and this allows for less sharing of common infrastructure. Other times, the network elements have specific physical layer adapters that cannot be abstracted or virtualized, and might require special DSP code and analog front-ends (AFEs) that do not lend themselves to implementation as VNEs 330, 332 or 334. These network elements can be included in transport layer 350.

The virtualized network function cloud 325 interfaces with the transport layer 350 to provide the VNEs 330, 332, 334, etc. to provide specific NFVs. In particular, the virtualized network function cloud 325 leverages cloud operations, applications, and architectures to support networking workloads. The virtualized network elements 330, 332 and 334 can employ network function software that provides either a one-for-one mapping of traditional network element function or alternately some combination of network functions designed for cloud computing. For example, VNEs 330, 332 and 334 can include route reflectors, domain name system (DNS) servers, and dynamic host configuration protocol (DHCP) servers, system architecture evolution (SAE) and/or mobility management entity (MME) gateways, broadband network gateways, IP edge routers for IP-VPN, Ethernet and other services, load balancers, distributers and other network elements. Because these elements don't typically need to forward large amounts of traffic, their workload can be distributed across a number of servers—each of which adds a portion of the capability, and overall which creates an elastic function with higher availability than its former monolithic version. These virtual network elements 330, 332, 334, etc. can be instantiated and managed using an orchestration approach similar to those used in cloud compute services.

The cloud computing environments 375 can interface with the virtualized network function cloud 325 via APIs that expose functional capabilities of the VNEs 330, 332, 334, etc. to provide the flexible and expanded capabilities to the virtualized network function cloud 325. In particular, network workloads may have applications distributed across the virtualized network function cloud 325 and cloud computing environment 375 and in the commercial cloud, or might simply orchestrate workloads supported entirely in NFV infrastructure from these third party locations.

Figure 4:
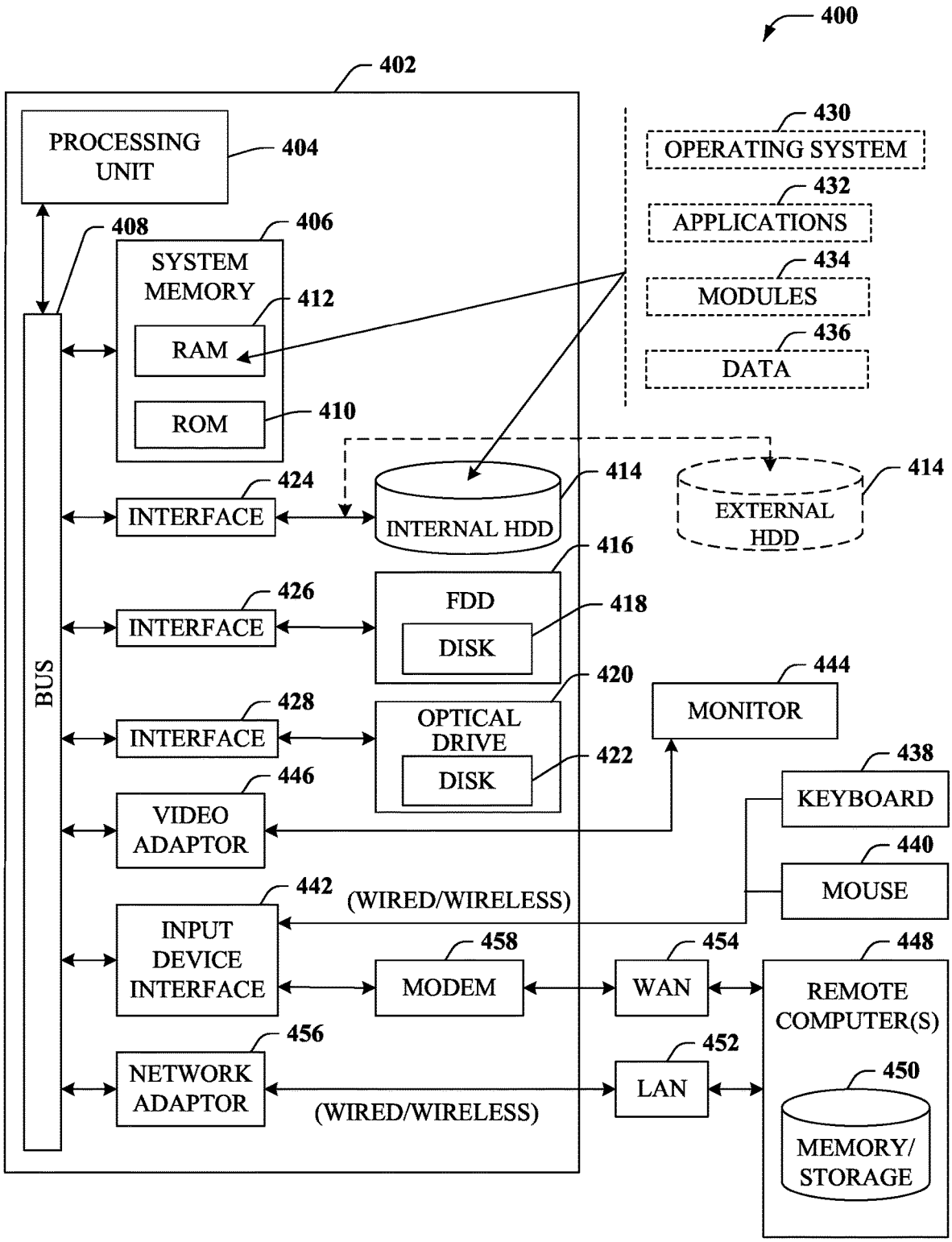
FIG. 4 is a block diagram of an example, non-limiting embodiment of a computing environment in accordance with various aspects described herein.

Turning now to FIG. 4, there is illustrated a block diagram of a computing environment in accordance with various aspects described herein. In order to provide additional context for various embodiments of the embodiments described herein, FIG. 4 and the following discussion are intended to provide a brief, general description of a suitable computing environment 400 in which the various embodiments of the subject disclosure can be implemented. In particular, computing environment 400 can be used in the implementation of network elements 150, 152, 154, 156, access terminal 112, base station or access point 122, switching device 132, media terminal 142, and/or VNEs 330, 332, 334, etc. Each of these devices can be implemented via computer-executable instructions that can run on one or more computers, and/or in combination with other program modules and/or as a combination of hardware and software. For example, computing environment 400 can facilitate in whole or in part components of system 200 for analyzing and modifying audio in content.

Generally, program modules comprise routines, programs, components, data structures, etc., that perform particular tasks or implement particular abstract data types. Moreover, those skilled in the art will appreciate that the inventive methods can be practiced with other computer system configurations, comprising single-processor or multiprocessor computer systems, minicomputers, mainframe computers, as well as personal computers, hand-held computing devices, microprocessor-based or programmable consumer electronics, and the like, each of which can be operatively coupled to one or more associated devices.

As used herein, a processing circuit includes one or more processors as well as other application specific circuits such as an application specific integrated circuit, digital logic circuit, state machine, programmable gate array or other circuit that processes input signals or data and that produces output signals or data in response thereto. It should be noted that while any functions and features described herein in association with the operation of a processor could likewise be performed by a processing circuit.

The illustrated embodiments of the embodiments herein can be also practiced in distributed processing environments where certain tasks are performed by remote processing devices that are linked through a communications network. In a distributed processing environment, program modules can be located in both local and remote memory storage devices.

Computing devices typically comprise a variety of media, which can comprise computer-readable storage media and/or communications media, which two terms are used herein differently from one another as follows. Computer-readable storage media can be any available storage media that can be accessed by the computer and comprises both volatile and nonvolatile media, removable and non-removable media. By way of example, and not limitation, computer-readable storage media can be implemented in connection with any method or technology for storage of information such as computer-readable instructions, program modules, structured data or unstructured data.

Computer-readable storage media can comprise, but are not limited to, random access memory (RAM), read only memory (ROM), electrically erasable programmable read only memory (EEPROM), flash memory or other memory technology, compact disk read only memory (CD-ROM), digital versatile disk (DVD) or other optical disk storage, magnetic cassettes, magnetic tape, magnetic disk storage or other magnetic storage devices or other tangible and/or non-transitory media which can be used to store desired information. In this regard, the terms "tangible" or "non-transitory" herein as applied to storage, memory or computer-readable media, are to be understood to exclude only propagating transitory signals per se as modifiers and do not relinquish rights to all standard storage, memory or computer-readable media that are not only propagating transitory signals per se.

Computer-readable storage media can be accessed by one or more local or remote computing devices, e.g., via access requests, queries or other data retrieval protocols, for a variety of operations with respect to the information stored by the medium.

Communications media typically embody computer-readable instructions, data structures, program modules or other structured or unstructured data in a data signal such as a modulated data signal, e.g., a carrier wave or other transport mechanism, and comprises any information delivery or transport media. The term "modulated data signal" or signals refers to a signal that has one or more of its characteristics set or changed in such a manner as to encode information in one or more signals. By way of example, and not limitation, communication media comprise wired media, such as a wired network or direct-wired connection, and wireless media such as acoustic, RF, infrared and other wireless media.

With reference again to FIG. 4, the example environment can comprise a computer 402, the computer 402 comprising a processing unit 404, a system memory 406 and a system bus 408. The system bus 408 couples system components including, but not limited to, the system memory 406 to the processing unit 404. The processing unit 404 can be any of various commercially available processors. Dual microprocessors and other multiprocessor architectures can also be employed as the processing unit 404.

The system bus 408 can be any of several types of bus structure that can further interconnect to a memory bus (with or without a memory controller), a peripheral bus, and a local bus using any of a variety of commercially available bus architectures. The system memory 406 comprises ROM 410 and RAM 412. A basic input/output system (BIOS) can be stored in a non-volatile memory such as ROM, erasable programmable read only memory (EPROM), EEPROM, which BIOS contains the basic routines that help to transfer information between elements within the computer 402, such as during startup. The RAM 412 can also comprise a high-speed RAM such as static RAM for caching data.

The computer 402 further comprises an internal hard disk drive (HDD) 414 (e.g., EIDE, SATA), which internal HDD 414 can also be configured for external use in a suitable chassis (not shown), a magnetic floppy disk drive (FDD) 416, (e.g., to read from or write to a removable diskette 418) and an optical disk drive 420, (e.g., reading a CD-ROM disk 422 or, to read from or write to other high capacity optical media such as the DVD). The HDD 414, magnetic FDD 416 and optical disk drive 420 can be connected to the system bus 408 by a hard disk drive interface 424, a magnetic disk drive interface 426 and an optical drive interface 428, respectively. The hard disk drive interface 424 for external drive implementations comprises at least one or both of Universal Serial Bus (USB) and Institute of Electrical and Electronics Engineers (IEEE) 1394 interface technologies. Other external drive connection technologies are within contemplation of the embodiments described herein.

The drives and their associated computer-readable storage media provide nonvolatile storage of data, data structures, computer-executable instructions, and so forth. For the computer 402, the drives and storage media accommodate the storage of any data in a suitable digital format. Although the description of computer-readable storage media above refers to a hard disk drive (HDD), a removable magnetic diskette, and a removable optical media such as a CD or DVD, it should be appreciated by those skilled in the art that other types of storage media which are readable by a computer, such as zip drives, magnetic cassettes, flash memory cards, cartridges, and the like, can also be used in the example operating environment, and further, that any such storage media can contain computer-executable instructions for performing the methods described herein.

A number of program modules can be stored in the drives and RAM 412, comprising an operating system 430, one or more application programs 432, other program modules 434 and program data 436. All or portions of the operating system, applications, modules, and/or data can also be cached in the RAM 412. The systems and methods described herein can be implemented utilizing various commercially available operating systems or combinations of operating systems.

A user can enter commands and information into the computer 402 through one or more wired/wireless input devices, e.g., a keyboard 438 and a pointing device, such as a mouse 440. Other input devices (not shown) can comprise a microphone, an infrared (IR) remote control, a joystick, a game pad, a stylus pen, touch screen or the like. These and other input devices are often connected to the processing unit 404 through an input device interface 442 that can be coupled to the system bus 408, but can be connected by other interfaces, such as a parallel port, an IEEE 1394 serial port, a game port, a universal serial bus (USB) port, an IR interface, etc.

A monitor 444 or other type of display device can be also connected to the system bus 408 via an interface, such as a video adapter 446. It will also be appreciated that in alternative embodiments, a monitor 444 can also be any display device (e.g., another computer having a display, a smart phone, a tablet computer, etc.) for receiving display information associated with computer 402 via any communication means, including via the Internet and cloud-based networks. In addition to the monitor 444, a computer typically comprises other peripheral output devices (not shown), such as speakers, printers, etc.

The computer 402 can operate in a networked environment using logical connections via wired and/or wireless communications to one or more remote computers, such as a remote computer(s) 448. The remote computer(s) 448 can be a workstation, a server computer, a router, a personal computer, portable computer, microprocessor-based entertainment appliance, a peer device or other common network node, and typically comprises many or all of the elements described relative to the computer 402, although, for purposes of brevity, only a remote memory/storage device 450 is illustrated. The logical connections depicted comprise wired/wireless connectivity to a local area network (LAN)

452 and/or larger networks, e.g., a wide area network (WAN) 454. Such LAN and WAN networking environments are commonplace in offices and companies, and facilitate enterprise-wide computer networks, such as intranets, all of which can connect to a global communications network, e.g., the Internet.

When used in a LAN networking environment, the computer 402 can be connected to the LAN 452 through a wired and/or wireless communication network interface or adapter 456. The adapter 456 can facilitate wired or wireless communication to the LAN 452, which can also comprise a wireless AP disposed thereon for communicating with the adapter 456.

When used in a WAN networking environment, the computer 402 can comprise a modem 458 or can be connected to a communications server on the WAN 454 or has other means for establishing communications over the WAN 454, such as by way of the Internet. The modem 458, which can be internal or external and a wired or wireless device, can be connected to the system bus 408 via the input device interface 442. In a networked environment, program modules depicted relative to the computer 402 or portions thereof, can be stored in the remote memory/storage device 450. It will be appreciated that the network connections shown are example and other means of establishing a communications link between the computers can be used.

The computer 402 can be operable to communicate with any wireless devices or entities operatively disposed in wireless communication, e.g., a printer, scanner, desktop and/or portable computer, portable data assistant, communications satellite, any piece of equipment or location associated with a wirelessly detectable tag (e.g., a kiosk, news stand, restroom), and telephone. This can comprise Wireless Fidelity (Wi-Fi) and BLUETOOTH® wireless technologies. Thus, the communication can be a predefined structure as with a conventional network or simply an ad hoc communication between at least two devices.

Wi-Fi can allow connection to the Internet from a couch at home, a bed in a hotel room or a conference room at work, without wires. Wi-Fi is a wireless technology similar to that used in a cell phone that enables such devices, e.g., computers, to send and receive data indoors and out; anywhere within the range of a base station. Wi-Fi networks use radio technologies called IEEE 802.11 (a, b, g, n, ac, ag, etc.) to provide secure, reliable, fast wireless connectivity. A Wi-Fi network can be used to connect computers to each other, to the Internet, and to wired networks (which can use IEEE 802.3 or Ethernet). Wi-Fi networks operate in the unlicensed 2.4 and 5 GHz radio bands for example or with products that contain both bands (dual band), so the networks can provide real-world performance similar to the basic 10BaseT wired Ethernet networks used in many offices.

Figure 5:
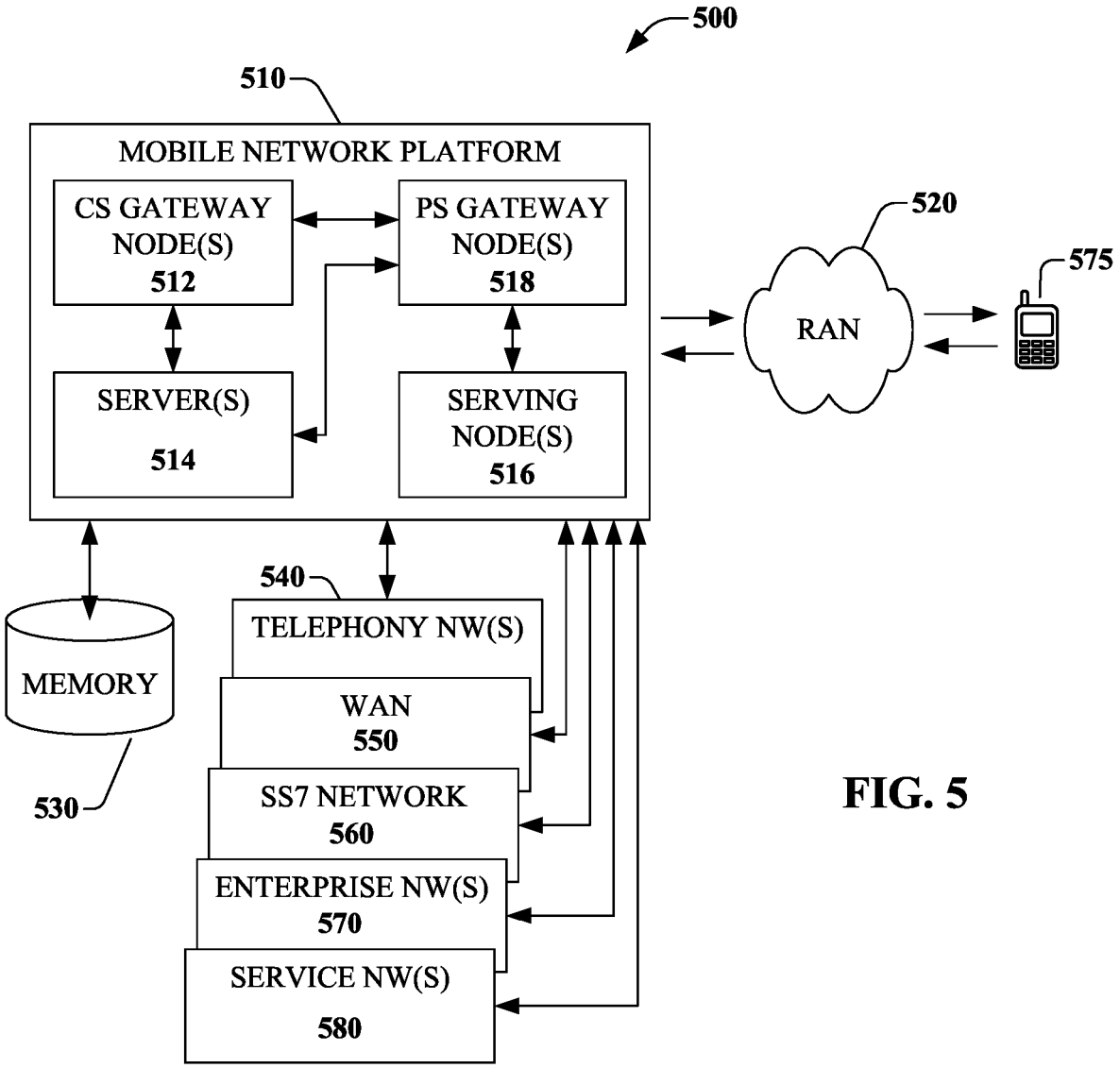
FIG. 5 is a block diagram of an example, non-limiting embodiment of a mobile network platform in accordance with various aspects described herein.

Turning now to FIG. 5, an embodiment 500 of a mobile network platform 510 is shown that is an example of network elements 150, 152, 154, 156, and/or VNEs 330, 332, 334, etc. For example, platform 510 can facilitate in whole or in part components of system 200 illustrated in FIG. 2A. In one or more embodiments, the mobile network platform 510 can generate and receive signals transmitted and received by base stations or access points such as base station or access point 122. Generally, mobile network platform 510 can comprise components, e.g., nodes, gateways, interfaces, servers, or disparate platforms, that facilitate both packet-switched (PS) (e.g., internet protocol (IP), frame relay, asynchronous transfer mode (ATM)) and circuit-switched (CS) traffic (e.g., voice and data), as well as control generation for networked wireless telecommunication. As a non-limiting example, mobile network platform 510 can be included in telecommunications carrier networks, and can be considered carrier-side components as discussed elsewhere herein. Mobile network platform 510 comprises CS gateway node(s) 512 which can interface CS traffic received from legacy networks like telephony network(s) 540 (e.g., public switched telephone network (PSTN), or public land mobile network (PLMN)) or a signaling system #7 (SS7) network 560. CS gateway node(s) 512 can authorize and authenticate traffic (e.g., voice) arising from such networks. Additionally, CS gateway node(s) 512 can access mobility, or roaming, data generated through SS7 network 560; for instance, mobility data stored in a visited location register (VLR), which can reside in memory 530. Moreover, CS gateway node(s) 512 interfaces CS-based traffic and signaling and PS gateway node(s) 518. As an example, in a 3GPP UMTS network, CS gateway node(s) 512 can be realized at least in part in gateway GPRS support node(s) (GGSN). It should be appreciated that functionality and specific operation of CS gateway node(s) 512, PS gateway node(s) 518, and serving node(s) 516, is provided and dictated by radio technology(ies) utilized by mobile network platform 510 for telecommunication over a radio access network 520 with other devices, such as a radiotelephone 575.

In addition to receiving and processing CS-switched traffic and signaling, PS gateway node(s) 518 can authorize and authenticate PS-based data sessions with served mobile devices. Data sessions can comprise traffic, or content(s), exchanged with networks external to the mobile network platform 510, like wide area network(s) (WANs) 550, enterprise network(s) 570, and service network(s) 580, which can be embodied in local area network(s) (LANs), can also be interfaced with mobile network platform 510 through PS gateway node(s) 518. It is to be noted that WANs 550 and enterprise network(s) 570 can embody, at least in part, a service network(s) like IP multimedia subsystem (IMS). Based on radio technology layer(s) available in technology resource(s) or radio access network 520, PS gateway node(s) 518 can generate packet data protocol contexts when a data session is established; other data structures that facilitate routing of packetized data also can be generated. To that end, in an aspect, PS gateway node(s) 518 can comprise a tunnel interface (e.g., tunnel termination gateway (TTG) in 3GPP UMTS network(s) (not shown)) which can facilitate packetized communication with disparate wireless network(s), such as Wi-Fi networks.

In embodiment 500, mobile network platform 510 also comprises serving node(s) 516 that, based upon available radio technology layer(s) within technology resource(s) in the radio access network 520, convey the various packetized flows of data streams received through PS gateway node(s) 518. It is to be noted that for technology resource(s) that rely primarily on CS communication, server node(s) can deliver traffic without reliance on PS gateway node(s) 518; for example, server node(s) can embody at least in part a mobile switching center. As an example, in a 3GPP UMTS network, serving node(s) 516 can be embodied in serving GPRS support node(s) (SGSN).

For radio technologies that exploit packetized communication, server(s) 514 in mobile network platform 510 can execute numerous applications that can generate multiple disparate packetized data streams or flows, and manage (e.g., schedule, queue, format . . . ) such flows. Such application(s) can comprise add-on features to standard services (for example, provisioning, billing, customer support . . . ) provided by mobile network platform 510. Data streams (e.g., content(s) that are part of a voice call or data session) can be conveyed to PS gateway node(s) 518 for authorization/authentication and initiation of a data session, and to serving node(s) 516 for communication thereafter. In addition to application server, server(s) 514 can comprise utility server(s), a utility server can comprise a provisioning server, an operations and maintenance server, a security server that can implement at least in part a certificate authority and firewalls as well as other security mechanisms, and the like. In an aspect, security server(s) secure communication served through mobile network platform 510 to ensure network's operation and data integrity in addition to authorization and authentication procedures that CS gateway node(s) 512 and PS gateway node(s) 518 can enact. Moreover, provisioning server(s) can provision services from external network(s) like networks operated by a disparate service provider; for instance, WAN 550 or Global Positioning System (GPS) network(s) (not shown). Provisioning server(s) can also provision coverage through networks associated to mobile network platform 510 (e.g., deployed and operated by the same service provider), such as the distributed antennas networks shown in FIG. 1(*s*) that enhance wireless service coverage by providing more network coverage.

It is to be noted that server(s) 514 can comprise one or more processors configured to confer at least in part the functionality of mobile network platform 510. To that end, the one or more processor can execute code instructions stored in memory 530, for example. It is should be appreciated that server(s) 514 can comprise a content manager, which operates in substantially the same manner as described hereinbefore.

In example embodiment 500, memory 530 can store information related to operation of mobile network platform 510. Other operational information can comprise provisioning information of mobile devices served through mobile network platform 510, subscriber databases; application intelligence, pricing schemes, e.g., promotional rates, flat-rate programs, couponing campaigns; technical specification(s) consistent with telecommunication protocols for operation of disparate radio, or wireless, technology layers; and so forth. Memory 530 can also store information from at least one of telephony network(s) 540, WAN 550, SS7 network 560, or enterprise network(s) 570. In an aspect, memory 530 can be, for example, accessed as part of a data store component or as a remotely connected memory store.

In order to provide a context for the various aspects of the disclosed subject matter, FIG. 5, and the following discussion, are intended to provide a brief, general description of a suitable environment in which the various aspects of the disclosed subject matter can be implemented. While the subject matter has been described above in the general context of computer-executable instructions of a computer program that runs on a computer and/or computers, those skilled in the art will recognize that the disclosed subject matter also can be implemented in combination with other program modules. Generally, program modules comprise routines, programs, components, data structures, etc. that perform particular tasks and/or implement particular abstract data types.

Figure 6:
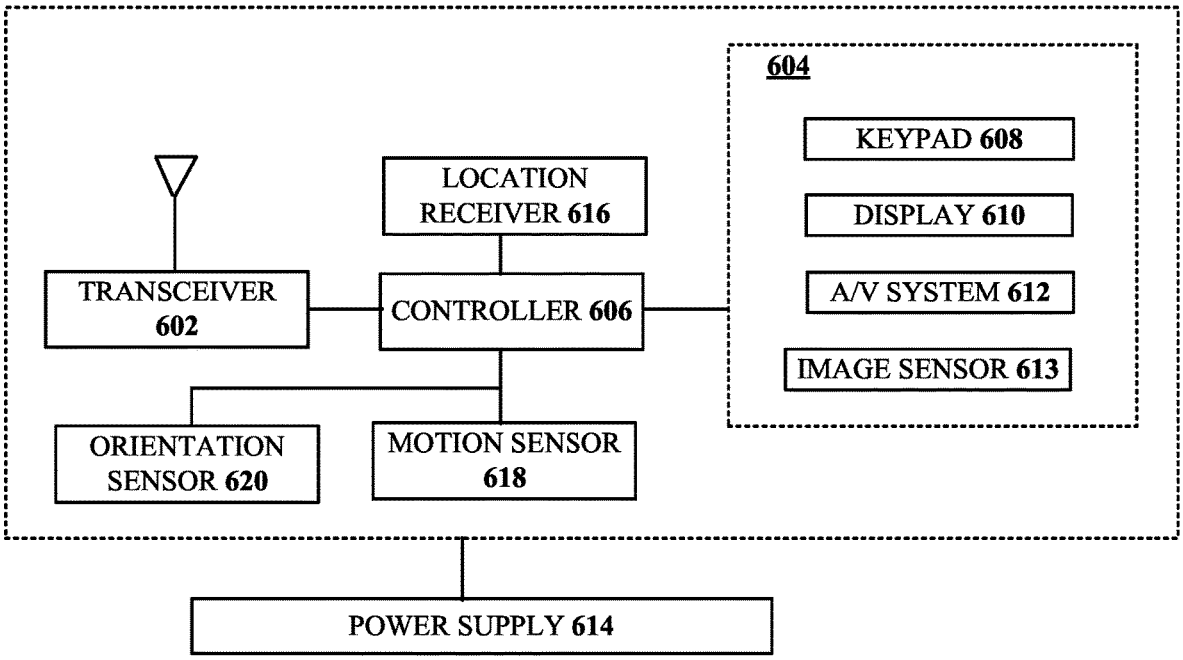
FIG. 6 is a block diagram of an example, non-limiting embodiment of a communication device in accordance with various aspects described herein.

Turning now to FIG. 6, an illustrative embodiment of a communication device 600 is shown. The communication device 600 can serve as an illustrative embodiment of devices such as data terminals 114, mobile devices 124, vehicle 126, display devices 144 or other client devices for communication via either communications network 125. For example, computing device 600 can facilitate in whole or in part components of system 200 illustrated in FIG. 2A.

The communication device 600 can comprise a wireline and/or wireless transceiver 602 (herein transceiver 602), a user interface (UI) 604, a power supply 614, a location receiver 616, a motion sensor 618, an orientation sensor 620, and a controller 606 for managing operations thereof. The transceiver 602 can support short-range or long-range wireless access technologies such as Bluetooth®, ZigBee®, WiFi, DECT, or cellular communication technologies, just to mention a few (Bluetooth® and ZigBee® are trademarks registered by the Bluetooth® Special Interest Group and the ZigBee® Alliance, respectively). Cellular technologies can include, for example, CDMA-1X, UMTS/HSDPA, GSM/GPRS, TDMA/EDGE, EV/DO, WiMAX, SDR, LTE, as well as other next generation wireless communication technologies as they arise. The transceiver 602 can also be adapted to support circuit-switched wireline access technologies (such as PSTN), packet-switched wireline access technologies (such as TCP/IP, VoIP, etc.), and combinations thereof.

The UI 604 can include a depressible or touch-sensitive keypad 608 with a navigation mechanism such as a roller ball, a joystick, a mouse, or a navigation disk for manipulating operations of the communication device 600. The keypad 608 can be an integral part of a housing assembly of the communication device 600 or an independent device operably coupled thereto by a tethered wireline interface (such as a USB cable) or a wireless interface supporting for example Bluetooth®. The keypad 608 can represent a numeric keypad commonly used by phones, and/or a QWERTY keypad with alphanumeric keys. The UI 604 can further include a display 610 such as monochrome or color LCD (Liquid Crystal Display), OLED (Organic Light Emitting Diode) or other suitable display technology for conveying images to an end user of the communication device 600. In an embodiment where the display 610 is touch-sensitive, a portion or all of the keypad 608 can be presented by way of the display 610 with navigation features.

The display 610 can use touch screen technology to also serve as a user interface for detecting user input. As a touch screen display, the communication device 600 can be adapted to present a user interface having graphical user interface (GUI) elements that can be selected by a user with a touch of a finger. The display 610 can be equipped with capacitive, resistive or other forms of sensing technology to detect how much surface area of a user's finger has been placed on a portion of the touch screen display. This sensing information can be used to control the manipulation of the GUI elements or other functions of the user interface. The display 610 can be an integral part of the housing assembly of the communication device 600 or an independent device communicatively coupled thereto by a tethered wireline interface (such as a cable) or a wireless interface.

The UI 604 can also include an audio system 612 that utilizes audio technology for conveying low volume audio (such as audio heard in proximity of a human ear) and high volume audio (such as speakerphone for hands free operation). The audio system 612 can further include a microphone for receiving audible signals of an end user. The audio system 612 can also be used for voice recognition applications. The UI 604 can further include an image sensor 613 such as a charged coupled device (CCD) camera for capturing still or moving images.

The power supply 614 can utilize common power management technologies such as replaceable and rechargeable batteries, supply regulation technologies, and/or charging system technologies for supplying energy to the components of the communication device 600 to facilitate long-range or short-range portable communications. Alternatively, or in combination, the charging system can utilize external power sources such as DC power supplied over a physical interface such as a USB port or other suitable tethering technologies.

The location receiver 616 can utilize location technology such as a global positioning system (GPS) receiver capable of assisted GPS for identifying a location of the communication device 600 based on signals generated by a constellation of GPS satellites, which can be used for facilitating location services such as navigation. The motion sensor 618 can utilize motion sensing technology such as an accelerometer, a gyroscope, or other suitable motion sensing technology to detect motion of the communication device 600 in three-dimensional space. The orientation sensor 620 can utilize orientation sensing technology such as a magnetometer to detect the orientation of the communication device 600 (north, south, west, and east, as well as combined orientations in degrees, minutes, or other suitable orientation metrics).

The communication device 600 can use the transceiver 602 to also determine a proximity to a cellular, WiFi, Bluetooth®, or other wireless access points by sensing techniques such as utilizing a received signal strength indicator (RSSI) and/or signal time of arrival (TOA) or time of flight (TOF) measurements. The controller 606 can utilize computing technologies such as a microprocessor, a digital signal processor (DSP), programmable gate arrays, application specific integrated circuits, and/or a video processor with associated storage memory such as Flash, ROM, RAM, SRAM, DRAM or other storage technologies for executing computer instructions, controlling, and processing data supplied by the aforementioned components of the communication device 600.

Other components not shown in FIG. 6 can be used in one or more embodiments of the subject disclosure. For instance, the communication device 600 can include a slot for adding or removing an identity module such as a Subscriber Identity Module (SIM) card or Universal Integrated Circuit Card (UICC). SIM or UICC cards can be used for identifying subscriber services, executing programs, storing subscriber data, and so on.

The terms "first," "second," "third," and so forth, as used in the claims, unless otherwise clear by context, is for clarity only and doesn't otherwise indicate or imply any order in time. For instance, "a first determination," "a second determination," and "a third determination," does not indicate or imply that the first determination is to be made before the second determination, or vice versa, etc.

In the subject specification, terms such as "store," "storage," "data store," data storage," "database," and substantially any other information storage component relevant to operation and functionality of a component, refer to "memory components," or entities embodied in a "memory" or components comprising the memory. It will be appreciated that the memory components described herein can be either volatile memory or nonvolatile memory, or can comprise both volatile and nonvolatile memory, by way of illustration, and not limitation, volatile memory, non-volatile memory, disk storage, and memory storage. Further, nonvolatile memory can be included in read only memory (ROM), programmable ROM (PROM), electrically programmable ROM (EPROM), electrically erasable ROM (EEPROM), or flash memory. Volatile memory can comprise random access memory (RAM), which acts as external cache memory. By way of illustration and not limitation, RAM is available in many forms such as synchronous RAM (SRAM), dynamic RAM (DRAM), synchronous DRAM (SDRAM), double data rate SDRAM (DDR SDRAM), enhanced SDRAM (ESDRAM), Synchlink DRAM (SLDRAM), and direct Rambus RAM (DRRAM). Additionally, the disclosed memory components of systems or methods herein are intended to comprise, without being limited to comprising, these and any other suitable types of memory.

Moreover, it will be noted that the disclosed subject matter can be practiced with other computer system configurations, comprising single-processor or multiprocessor computer systems, mini-computing devices, mainframe computers, as well as personal computers, hand-held computing devices (e.g., PDA, phone, smartphone, watch, tablet computers, netbook computers, etc.), microprocessor-based or programmable consumer or industrial electronics, and the like. The illustrated aspects can also be practiced in distributed computing environments where tasks are performed by remote processing devices that are linked through a communications network; however, some if not all aspects of the subject disclosure can be practiced on stand-alone computers. In a distributed computing environment, program modules can be located in both local and remote memory storage devices.

In one or more embodiments, information regarding use of services can be generated including services being accessed, media consumption history, user preferences, and so forth. This information can be obtained by various methods including user input, detecting types of communications (e.g., video content vs. audio content), analysis of content streams, sampling, and so forth. The generating, obtaining and/or monitoring of this information can be responsive to an authorization provided by the user. In one or more embodiments, an analysis of data can be subject to authorization from user(s) associated with the data, such as an opt-in, an opt-out, acknowledgement requirements, notifications, selective authorization based on types of data, and so forth.

Some of the embodiments described herein can also employ artificial intelligence (AI) to facilitate automating one or more features described herein. The embodiments (e.g., in connection with automatically identifying acquired cell sites that provide a maximum value/benefit after addition to an existing communication network) can employ various AI-based schemes for carrying out various embodiments thereof. Moreover, the classifier can be employed to determine a ranking or priority of each cell site of the acquired network. A classifier is a function that maps an input attribute vector, $x=(x_1, x_2, x_3, x_4 \ldots x_n)$, to a confidence that the input belongs to a class, that is, f(x) =confidence (class). Such classification can employ a probabilistic and/or statistical-based analysis (e.g., factoring into the analysis utilities and costs) to determine or infer an action that a user desires to be automatically performed. A support vector machine (SVM) is an example of a classifier that can be employed. The SVM operates by finding a hypersurface in the space of possible inputs, which the hypersurface attempts to split the triggering criteria from the non-triggering events. Intuitively, this makes the classification correct for testing data that is near, but not identical to training data. Other directed and undirected model classification approaches comprise, e.g., naïve Bayes, Bayesian networks, decision trees, neural networks, fuzzy logic models, and probabilistic classification models providing different patterns of independence can be employed. Classification as used herein also is inclusive of statistical regression that is utilized to develop models of priority.

As will be readily appreciated, one or more of the embodiments can employ classifiers that are explicitly trained (e.g., via a generic training data) as well as implicitly trained (e.g., via observing UE behavior, operator preferences, historical information, receiving extrinsic information). For example, SVMs can be configured via a learning or training phase within a classifier constructor and feature selection module. Thus, the classifier(s) can be used to automatically learn and perform a number of functions, including but not limited to determining according to predetermined criteria which of the acquired cell sites will benefit a maximum number of subscribers and/or which of the acquired cell sites will add minimum value to the existing communication network coverage, etc.

As used in some contexts in this application, in some embodiments, the terms "component," "system" and the like are intended to refer to, or comprise, a computer-related entity or an entity related to an operational apparatus with one or more specific functionalities, wherein the entity can be either hardware, a combination of hardware and software, software, or software in execution. As an example, a component may be, but is not limited to being, a process running on a processor, a processor, an object, an executable, a thread of execution, computer-executable instructions, a program, and/or a computer. By way of illustration and not limitation, both an application running on a server and the server can be a component. One or more components may reside within a process and/or thread of execution and a component may be localized on one computer and/or distributed between two or more computers. In addition, these components can execute from various computer readable media having various data structures stored thereon. The components may communicate via local and/or remote processes such as in accordance with a signal having one or more data packets (e.g., data from one component interacting with another component in a local system, distributed system, and/or across a network such as the Internet with other systems via the signal). As another example, a component can be an apparatus with specific functionality provided by mechanical parts operated by electric or electronic circuitry, which is operated by a software or firmware application executed by a processor, wherein the processor can be internal or external to the apparatus and executes at least a part of the software or firmware application. As yet another example, a component can be an apparatus that provides specific functionality through electronic components without mechanical parts, the electronic components can comprise a processor therein to execute software or firmware that confers at least in part the functionality of the electronic components. While various components have been illustrated as separate components, it will be appreciated that multiple components can be implemented as a single component, or a single component can be implemented as multiple components, without departing from example embodiments.

Further, the various embodiments can be implemented as a method, apparatus or article of manufacture using standard programming and/or engineering techniques to produce software, firmware, hardware or any combination thereof to control a computer to implement the disclosed subject matter. The term "article of manufacture" as used herein is intended to encompass a computer program accessible from any computer-readable device or computer-readable storage/communications media. For example, computer readable storage media can include, but are not limited to, magnetic storage devices (e.g., hard disk, floppy disk, magnetic strips), optical disks (e.g., compact disk (CD), digital versatile disk (DVD)), smart cards, and flash memory devices (e.g., card, stick, key drive). Of course, those skilled in the art will recognize many modifications can be made to this configuration without departing from the scope or spirit of the various embodiments.

In addition, the words "example" and "exemplary" are used herein to mean serving as an instance or illustration. Any embodiment or design described herein as "example" or "exemplary" is not necessarily to be construed as preferred or advantageous over other embodiments or designs. Rather, use of the word example or exemplary is intended to present concepts in a concrete fashion. As used in this application, the term "or" is intended to mean an inclusive "or" rather than an exclusive "or". That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Moreover, terms such as "user equipment," "mobile station," "mobile," subscriber station," "access terminal," "terminal," "handset," "mobile device" (and/or terms representing similar terminology) can refer to a wireless device utilized by a subscriber or user of a wireless communication service to receive or convey data, control, voice, video, sound, gaming or substantially any data-stream or signaling-stream. The foregoing terms are utilized interchangeably herein and with reference to the related drawings.

Furthermore, the terms "user," "subscriber," "customer," "consumer" and the like are employed interchangeably throughout, unless context warrants particular distinctions among the terms. It should be appreciated that such terms can refer to human entities or automated components supported through artificial intelligence (e.g., a capacity to make inference based, at least, on complex mathematical formalisms), which can provide simulated vision, sound recognition and so forth.

As employed herein, the term "processor" can refer to substantially any computing processing unit or device comprising, but not limited to comprising, single-core processors; single-processors with software multithread execution capability; multi-core processors; multi-core processors with software multithread execution capability; multi-core processors with hardware multithread technology; parallel platforms; and parallel platforms with distributed shared memory. Additionally, a processor can refer to an integrated circuit, an application specific integrated circuit (ASIC), a digital signal processor (DSP), a field programmable gate array (FPGA), a programmable logic controller (PLC), a complex programmable logic device (CPLD), a discrete gate or transistor logic, discrete hardware components or any combination thereof designed to perform the functions described herein. Processors can exploit nano-scale architectures such as, but not limited to, molecular and quantum-dot based transistors, switches and gates, in order to optimize space usage or enhance performance of user equipment. A processor can also be implemented as a combination of computing processing units.

As used herein, terms such as "data storage," data storage," "database," and substantially any other information storage component relevant to operation and functionality of a component, refer to "memory components," or entities embodied in a "memory" or components comprising the memory. It will be appreciated that the memory components or computer-readable storage media, described herein can be either volatile memory or nonvolatile memory or can include both volatile and nonvolatile memory.

What has been described above includes mere examples of various embodiments. It is, of course, not possible to describe every conceivable combination of components or methodologies for purposes of describing these examples, but one of ordinary skill in the art can recognize that many further combinations and permutations of the present embodiments are possible. Accordingly, the embodiments disclosed and/or claimed herein are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

In addition, a flow diagram may include a "start" and/or "continue" indication. The "start" and "continue" indications reflect that the steps presented can optionally be incorporated in or otherwise used in conjunction with other routines. In this context, "start" indicates the beginning of the first step presented and may be preceded by other activities not specifically shown. Further, the "continue" indication reflects that the steps presented may be performed multiple times and/or may be succeeded by other activities not specifically shown. Further, while a flow diagram indicates a particular ordering of steps, other orderings are likewise possible provided that the principles of causality are maintained.

As may also be used herein, the term(s) "operably coupled to", "coupled to", and/or "coupling" includes direct coupling between items and/or indirect coupling between items via one or more intervening items. Such items and intervening items include, but are not limited to, junctions, communication paths, components, circuit elements, circuits, functional blocks, and/or devices. As an example of indirect coupling, a signal conveyed from a first item to a second item may be modified by one or more intervening items by modifying the form, nature or format of information in a signal, while one or more elements of the information in the signal are nevertheless conveyed in a manner than can be recognized by the second item. In a further example of indirect coupling, an action in a first item can cause a reaction on the second item, as a result of actions and/or reactions in one or more intervening items.

Although specific embodiments have been illustrated and described herein, it should be appreciated that any arrangement which achieves the same or similar purpose may be substituted for the embodiments described or shown by the subject disclosure. The subject disclosure is intended to cover any and all adaptations or variations of various embodiments. Combinations of the above embodiments, and other embodiments not specifically described herein, can be used in the subject disclosure. For instance, one or more features from one or more embodiments can be combined with one or more features of one or more other embodiments. In one or more embodiments, features that are positively recited can also be negatively recited and excluded from the embodiment with or without replacement by another structural and/or functional feature. The steps or functions described with respect to the embodiments of the subject disclosure can be performed in any order. The steps or functions described with respect to the embodiments of the subject disclosure can be performed alone or in combination with other steps or functions of the subject disclosure, as well as from other embodiments or from other steps that have not been described in the subject disclosure. Further, more than or less than all of the features described with respect to an embodiment can also be utilized.

What is claimed is:

1. A device, comprising:

a processing system including a processor; and a memory that stores executable instructions that, when executed by the processing system, facilitate performance of operations, the operations comprising:

determining parameters for adapting audio in content to the device, wherein the parameters are based on semantic metadata embedded in the content;

based on a determination that a first semantic in the semantic metadata corresponds to audio output at a particular frequency range and that the device lacks a capability to produce the audio output at the particular frequency range, defining an instruction for controlling a vibration mechanism of the device to provide a vibration effect; and during rendering of the content, causing, based on the instruction, the vibration mechanism to provide the vibration effect as a substitute for the audio output at the particular frequency range.

2. The device of claim 1, wherein the parameters represent a plurality of semantics in a game context, environment context, or a combination thereof.

3. The device of claim 1, wherein the parameters are determined from external device models that are specific to the device.

4. The device of claim 1, wherein the operations further comprise receiving feedback from a user, and wherein the feedback rates the rendering.

5. The device of claim 1, wherein the device lacks a subwoofer.

6. The device of claim 1, wherein the processing system comprises a plurality of processors operating in a distributed processing environment.

7. The device of claim 1, wherein the adapting modifies the audio according to pitch, cadence, tempo, key, spectral signature, or a combination thereof.

8. The device of claim 1, wherein the adapting manipulates the audio using audio processing algorithms, wherein the operations further comprise performing an analysis of input signals obtained via a microphone of the device, determining, based on the analysis, that an initial adaptation of the audio based on the parameters satisfies a condition, and defining an adjustment parameter responsive to the determining that the initial adaptation of the audio based on the parameters satisfies the condition, and wherein the adapting the audio is further based on the adjustment parameter.

9. The device of claim 1, wherein the adapting modifies the audio according to performance semantics.

10. The device of claim 1, wherein the adapting modifies the audio to accommodate available resources on the device.

11. A non-transitory machine-readable medium, comprising executable instructions that, when executed by a processing system including a processor, facilitate performance of operations, the operations comprising:

determining instructions for manipulating audio in content, wherein the instructions are based on semantic metadata embedded in the content;

based on a first determination that a first semantic in the semantic metadata corresponds to audio output at a particular frequency and based on a second determination that a device for rendering the content lacks a capability to produce the audio output at the particular frequency, defining a parameter for controlling a vibration mechanism of the device to provide a vibration effect; and sending the parameter to the device to cause the vibration mechanism of the device to provide the vibration effect as a substitute for the audio output at the particular frequency.

12. The non-transitory machine-readable medium of claim 11, wherein the processing system comprises a plurality of processors operating in a distributed processing environment.

13. The non-transitory machine-readable medium of claim 11, wherein the instructions are determined from external device models that are specific to the device.

14. The non-transitory machine-readable medium of claim 11, wherein the operations further comprise receiving feedback from a user, and wherein the feedback rates the rendering.

15. The non-transitory machine-readable medium of claim 11, wherein the device lacks a subwoofer.

16. The non-transitory machine-readable medium of claim 11, wherein the manipulating modifies the audio according to pitch, cadence, tempo, key, spectral signature, or a combination thereof.

17. A method, comprising:

determining, by a processing system of a device including a processor, instructions for manipulating audio in content, wherein the instructions are determined based on semantic metadata embedded in the content;

responsive to a determination that a first semantic of a plurality of semantics in the semantic metadata corresponds to audio output at a particular frequency range and that the device lacks a capability to produce the audio output at the particular frequency range, defining, by the processing system, a parameter for controlling a vibration mechanism of the device to provide a vibration effect; and during rendering of the content, causing, by the processing system and based on the parameter, the vibration mechanism to provide the vibration effect as a substitute for the audio output at the particular frequency range.

18. The method of claim 17, wherein the manipulating modifies the audio in pitch, cadence, tempo, key, spectral signature, or a combination thereof.

19. The method of claim 17, wherein the instructions relate to audio processing algorithms.

20. The method of claim 17, wherein the device lacks a subwoofer.

* * * * *